United States Patent [19]

Hockings et al.

[11] 4,316,126

[45] Feb. 16, 1982

[54] COLOR TELEVISION PICTURE TUBE WITH COLOR-SELECTION STRUCTURE AND METHOD OF OPERATION THEREOF

[75] Inventors: Eric F. Hockings, Princeton; Carmen A. Catanese, Rocky Hill, both of N.J.

[73] Assignee: RCA Corporation, New York, N.Y.

[21] Appl. No.: 96,974

[22] Filed: Nov. 23, 1979

[51] Int. Cl.[3] ..... H01J 29/80

[52] U.S. Cl. ..... 315/375; 313/403

[58] Field of Search ..... 315/375, 368; 313/408, 313/402, 403

[56] References Cited

U.S. PATENT DOCUMENTS

Re. 25,091 11/1961 Ramberg .
4,059,781 11/1977 Van Alphen et al. ..... 313/403
4,112,563 9/1978 Van Esdonk .

FOREIGN PATENT DOCUMENTS 2814391 10/1978 Fed. Rep. of Germany .

*Primary Examiner*—Theodore M. Blum
*Attorney, Agent, or Firm*—E. M. Whitacre; G. H. Bruestle; L. Greenspan

[57] ABSTRACT

CPT comprises a deflection-and-focus color-selection masking structure, a screen of parallel phosphor stripes, and means for producing three convergent in-line electron beams directed towards the target. When the CPT is operated, pairs of beamlets transmitted through windows in adjacent apertures in the masking structure are deflected towards one another to excite the same phosphor stripe and, also, are focused (compressed) in the narrow width direction of the phosphor stripes and defocused (stretched) in the length direction of the phosphor stripes.

12 Claims, 15 Drawing Figures

COLOR TELEVISION PICTURE TUBE WITH COLOR-SELECTION STRUCTURE AND METHOD OF OPERATION THEREOF

BACKGROUND OF THE INVENTION

This invention relates to an improved focus-mask-type CPT (color television picture tube) and to a method for operating this improved CPT.

A commercial shadow-mask-type CPT comprises generally an avacuated envelope having therein a target comprising an array of phosphor elements of three different emission colors arranged in cyclic order, means for producing three convergent electron beams directed towards the target, and a color-selection structure including an apertured masking plate between the target and the beam-producing means. The masking plate shadows the target, and the differences in convergence angles permit the transmitted portions of each beam, or beamlets, to select and excite phosphor elements of the desired emission color.

At about the center of the color-selection structure, the masking plate of a commercial CPT intercepts all but about 18% of the beam currents; that is, the plate is said to have a transmission of about 18%. Thus, the area of the apertures of the plate is about 18% of the area of the mask. Since there are no focusing fields present, a corresponding portion of the target is excited by the beamlets of each electron beam.

Several methods have been suggested for increasing the transmission of the masking plate; that is, increasing the area of the apertures with respect to the area of the plate, without substantially increasing the excited portions of the target area. In one approach, the apertures are enlarged, and the beamlets are focused by magnetic or electric fields produced in the vicinity of each of the apertures. In a second approach, each aperture in the masking plate is enlarged and split into two adjacent windows by a conductor. The two beamlets passing through the windows of each aperture are deflected around the conductor towards one another, and both beamlets fall on substantially the same area of the target. In this second approach, the transmitted portions of the beams are also focused in one transverse direction and defocused in the orthogonal transverse direction.

One effort at such a combined deflection-and-focus color-selection means is described in West German Offenlegungschrift No. 2,814,391 published Oct. 19, 1978. That publication discloses a CPT having a target, as normally viewed, comprised of a mosaic of vertical phosphor stripes of three different emission colors arranged cyclically on triads (groups of three different stripes), means for producing three convergent horizontally in-line electron beams directed towards the target, and a color-selection structure located adjacent the target. The color-selection structure comprises a metal-masking plate having therein an array of substantially square apertures arranged in vertical columns and an array of narrow vertical conductors insulatingly spaced from the masking plate, with each conductor substantially centered over the apertures of one of the columns of apertures. Each aperture is also centered over a triad of phosphor stripes. Viewed from the electron-beam-producing means, the conductors divide each aperture into two essentially-equal horizontally-coadjacent windows. This prior color-selection structure has windows with a width-to-height ratio of about 0.46 and transmits about 44% or less of the electron beams.

When operating this latter device, the narrow vertical conductors are electrically positive with respect to the masking plate, so that the beamlets passing through each of the windows of the same aperture are deflected towards one another. Simultaneously, because of quadrupole-like focusing fields established in the windows, the beamlets are focused in the length direction of the phosphor stripes (compressed vertically) and defocused in the width direction of the phosphor stripes (stretched horizontally). The spacings and voltages are so chosen to form an electrostatic lens that also deflects the two beam parts to fall on the same phosphor stripe of the target. The convergence angle of the beam that produces the beamlet determines which stripe of the triad is selected. The voltage at the center of each window is higher than at the top and bottom thereof (resulting in vertical focusing) and is lower than at the left and right thereof (resulting in horizontal defocusing).

Careful analysis and experience with this color-selection structure have shown that the shapes of the deflected beamlets passing through each window, because they are elongated in the width (horizontal) direction and compressed in the length (vertical) direction, cause an overlapping of the beamlets onto the adjacent incorrect color phosphor stripe, or require a reduction in the widths of the windows, to assure adequate color purity in the image displayed on the target.

SUMMARY OF THE INVENTION

The novel CPT employs a deflection-and-focus color-selection structure and a screen comprised of parallel phosphor stripes. Unlike the above-described prior CPT, the novel CPT employs a color-selection structure which focuses the beamlets in the narrow width direction of the phosphor stripes, and defocuses the beamlets in the long length direction of the phosphor stripes. With the beamlets compressed in the width direction of the phosphor stripes, the width/height ratios of the windows and the overall transmission of the color-selection structure can be increased. The color-selection structure is relocated with respect to the phosphor stripes in order to make the novel CPT operative.

The novel CPT includes (a) a target comprising an array of substantially parallel stripes of three different emission colors arranged in cyclic order in adjacent triads, each triad comprising a stripe of each of the three different emission colors, (b) means for producing three convergent in-line electron beams directed towards the target in a plane that is substantially normal to the length of the phosphor stripes, and (c) a color-selection structure positioned between the target and the beam-producing means. The color-selection structure comprises (i) a metal masking plate having therein an array of apertures arranged in columns that are substantially parallel to the length of said phosphor stripes, and (ii) an array of narrow conductors extending substantially parallel to the length of said stripes and insulatingly spaced from said masking plate. Each conductor is substantially centered over the apertures of one of said columns, so that the masking plate and the conductors define an array of windows for transmitting therethrough portions of said electron beams. The conductors are located opposite and spaced from the boundaries between adjacent triads.

During the operation of the novel CPT, the polarities on the masking plate and the conductors are maintained so that the conductors are negative with respect to the masking plate. When so operated, the beamlets passing through each of the windows of the same apertures are deflected away from one another. Beamlets from adjacent windows of adjacent apertures fall on the same stripe of the target. This requires the boundary of each triad, rather than the center of each triad, to be opposite the conductor. By using this novel arrangement of color-selection structure and screen and by operating the novel CPT in this manner, the transmitted beamlets are compressed (focused) in the direction normal to the lengths of the conductors and of the phosphor stripes, and are stretched (defocused) in the direction parallel to the lengths of the conductors and of the phosphor stripes. This reduces the widths of the beamlets and permits the transmission of the color-selection structure to be increased with improved registration of the beamlets on the phosphor stripes.

In order to further enhance the transmission of the color-selection structure without otherwise degrading the color purity of the displayed image, it has been found desirable to provide windows having width-to-height ratios significantly greater than 0.47. Preferably, the windows are substantially square; that is, they have width-to-height ratios in the range of 0.8 to 1.1. With such ratios, a color-selection structure of the novel CPT can exhibit a transmission greater than 44%, without sacrificing other desirable operating characteristics in the operation of the CPT.

DETAILED DESCRIPTION OF THE PREFERRED EMBODIMENT

Figure 1:
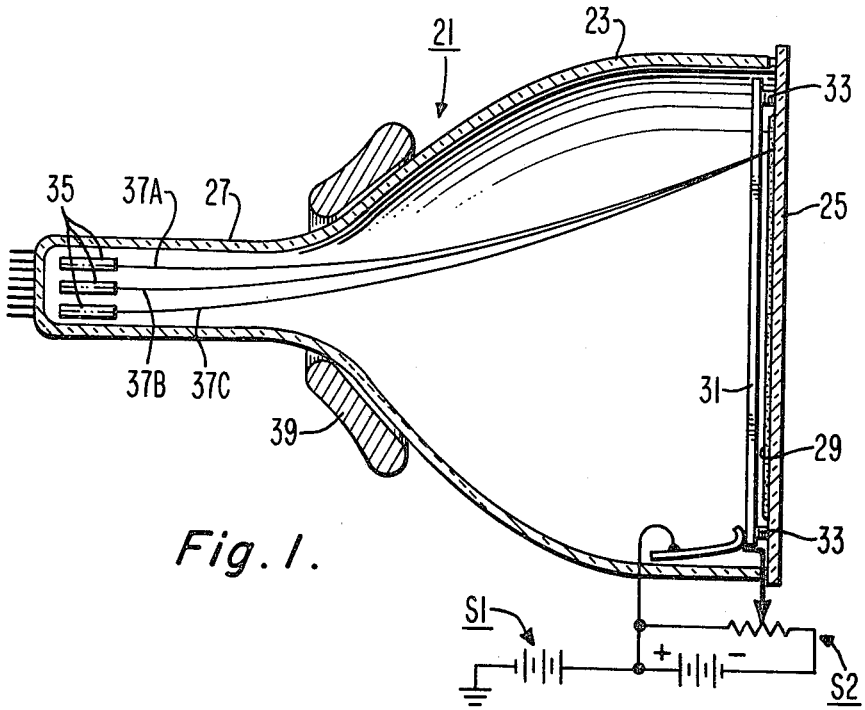
FIG. 1 is a partially-schematic sectional top view of en embodiment of a novel CPT.

The novel color television picture tube 21 shown in FIG. 1 comprises an evacuated bulb 23 including a transparent faceplate 25 at one end and a neck 27 at the other end. The faceplate 25, which is flat, but may arch outwardly, supports a luminescent viewing screen or target 29 on its inner surface. Also, a color-selection structure 31 is supported from three supports 33 on the inside surface of the faceplate 25. Means 35 for generating three electron beams 37A, 37B and 37C are housed in the neck 27. The beams are generated in substantially a plane, which is preferably horizontal in the normal viewing position. The beams are directed towards the screen 29 with the outer beams 37A and 37C convergent on the center beam 37B at the target 29. The three beams may be deflected with the aid of a deflection coil 39 to scan a raster over the color-selection structure 31 and the viewing screen 29.

Figure 2:
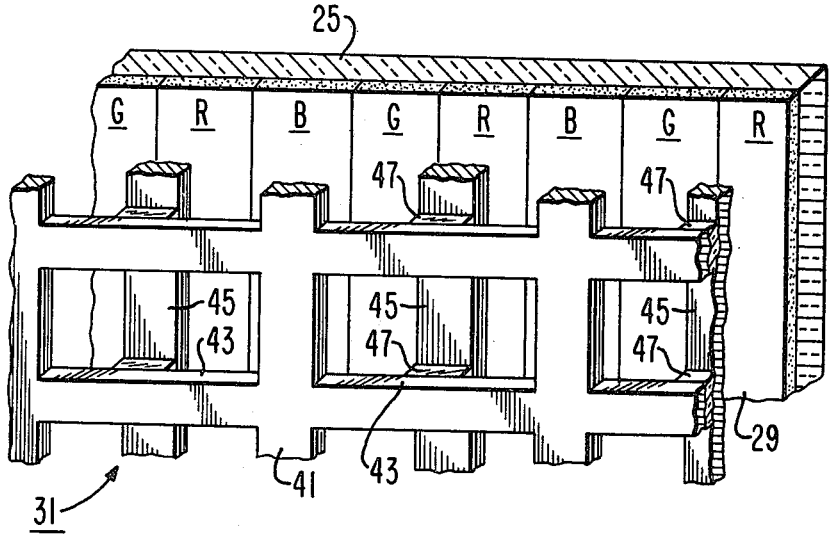
FIG. 2 is a perspective view of fragments of the color-selection structure and the viewing screen of the CPT shown in FIG. 1 including a masking plate having rectangular apertures therein arranged in vertical columns and horizontal lines.
Figure 4:
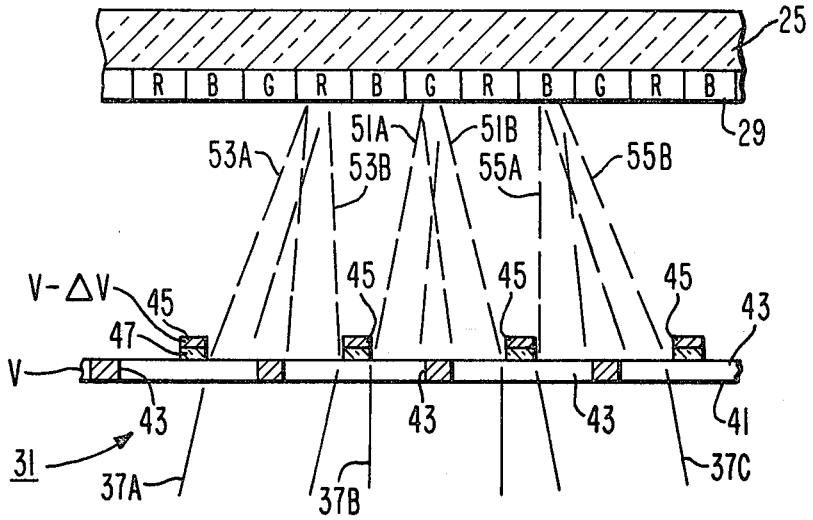
FIG. 4 is a partially schematic, sectional top view of fragments of the color-selection structure and viewing screen of FIG. 1 showing typical focused convergent electron paths during the operation of the novel CPT.

The viewing screen 29 and the color-selection structure 31 are described in more detail with respect to FIGS. 2 and 4. The viewing screen 29 is comprised of a large number of red-emitting, green-emitting and blue-emitting phosphor stripes R, G and B respectively arranged in triads in a cyclic order and extending in a direction which is generally normal to the plane in which the electron beams are generated. In the normal viewing position for this embodiment, the phosphor stripes extend in the vertical direction.

Figure 9A:
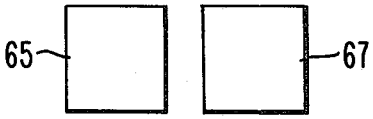
FIGS. 9A and 9B are a set of diagrams showing the electron-spot shapes on the target produced by the operation of the novel CPT.
Figure 9B:
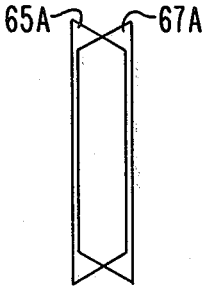

The color-selection structure 31 comprises a masking plate 41 having a large number of rectangular openings or apertures 43 therein. The apertures 43 are arranged in columns, which are parallel to the long direction of the phosphor stripes R, G and B, there being one column of apertures for each triad of stripes. The green stripe is at the center of each triad, and, as shown in FIG. 4, is in line with the space between columns of apertures. The red stripe R is to the right and the blue stripe B is to the left of the green stripe G as viewed from the electron-beam-producing means 35. Each narrow conductor 45 is closely spaced from the masking plate 41 by insulators 47 that are about 0.025 mm (1 mil) thick. A conductor 45 extends down each column of apertures 43 on the screen side of the masking plate 41 and opposite each triad boundary; that is, opposite the boundary between the red and blue stripes R and B. Alternatively, the conductors 45 may extend down each column of apertures on the beam-producing side of the plate 41. The conductors 45 are parallel to the stripes R, G and B. The conductors 45 are so positioned over each aperture 43 so as to leave two substantially equal electron-transmitting parts or windows, as viewed from the electron-beam-producing means 35. In this embodiment, the apertures 43 at the center of the plate 41 are about 0.65 mm (26 mils) wide by 0.31 mm (12 mils) high. The apertures are spaced about 0.14 mm (6 mils) apart from adjacent apertures above and below. To the sides, the spacing is about 0.11 mm (4 mils). The conductors are about 0.15 mm (6 mils) wide leaving two equal open parts or windows on each side thereof that are about 0.31 mm (12 mils) high and 0.25 mm (10 mils) wide. The masking plate 41 is spaced about 12.7 mm (540 mils) from the phosphor stripes R, G and B.

dows of the same aperture are deflected away from one another. The beamlet passing through each window is deflected onto the same phosphor stripe as the adjacent beamlet passing through the adjacent window of the adjacent aperture in the deflected direction, as shown in FIG. 4. As the beamlets pass through adjacent windows of adjacent apertures and are deflected towards one another in the deflected (horizontal) direction, they are simultaneously focused in that direction and defocused in the transverse nondeflected (vertical) direction. Thus, the electron spots at the target, with no voltage difference applied between the masking plate 41 and the conductors 45, look like the areas 65 and 67 shown in FIG. 9A, which is substantially the same shape and size as the windows in the selection structure that formed them. After deflection and focusing; that is, with the voltage difference applied, the electron spots on the target look like the areas 65A and 67A; that is, they are narrower in the deflected direction and taller in the transverse direction, as shown in FIG. 9B. This results in greater misregistration tolerance and better color purity than for the prior mode of operation. Part or all of the misregistration tolerance can be traded for greater transmission by the color-selection structure.

A deflection-and-focusing color-selection structure of the novel CPT can be considered as combining the properties of a deflection grille and a focusing mask. A superior color-selection structure of this type is one in which the quadrupole (focusing) component is increased with respect to the dipole (deflection) component. This produces narrower electron beam spots onto the screen, and there can be a greater tolerance in their position with respect to the phosphor stripes they are to excite. Color purity can be more readily maintained. The quadrupole component is enhanced by decreasing the height of the windows (the direction parallel to the length of the conductors) with respect to their width (the direction normal to the length of the conductors), while maintaining an overall transmission of the color-selection structure at much greater than 18%.

To evaluate the relationship between the window width and height, use is made of the ratio of width/height (w/h). The desired intent of strengthening the focusing effect is accomplished by increasing the ratio width/height. The effects of such a change are shown in Table II. Within each horizontal repeat distance, there are two windows of the given dimensions. As shown in Table II, when the value of w/h is increased from 0.45 to 0.80, the differential voltage $\Delta V$ needed to achieve color purity on a phosphor stripe at 540 mils from the mask decreases from 1,000 to 500 volts. This decrease is advantageous since the insulators (shown as 47 in FIG. 2) between the apertured plate and the narrow conductors are then subjected to a lower electrical stress. Generally, the value of $\Delta V$ may be in the range of 100 to 1,000 volts.

In the novel CPT, the thickness of the masking plate may be in the range of about 0.10 mm (4 mils) to about 0.20 mm (8 mils) and is preferably about 0.15 mm (6 mils) thick. The lower limit is determined at least by the mechanical rigidity and strength required for making and using the CPT. The upper limit is determined at least by the cost of materials and the ability to achieve good aperture definition during fabrication. Increasing the thickness of the masking plate in the range of 0.10 to 0.20 mm may require a reduction in $\Delta V$ of about 12%. But, a thicker masking plate may result in lower transmissions in those areas of the plate where the electron beams are incident at oblique angles.

TABLE I

Figure 5:
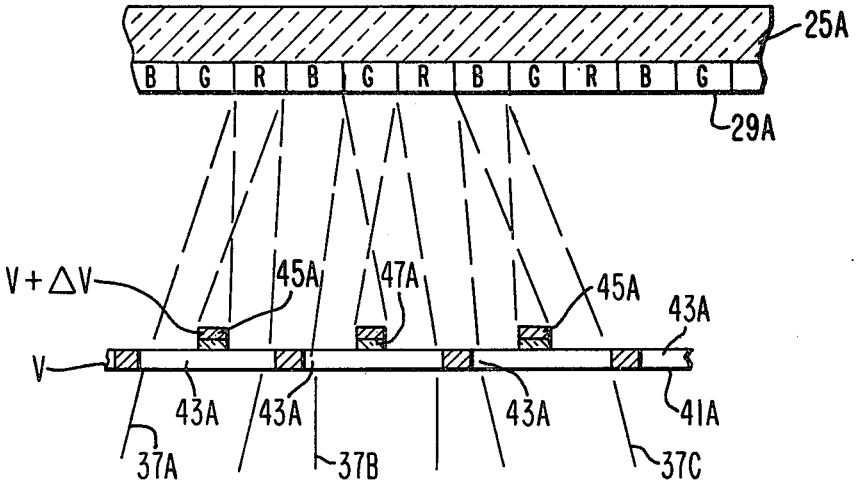
Fig. 5. PRIOR ART
FIG. 5 is a diagram similar to that of FIG. 4 but for a prior CPT and mode of operation showing typical defocused convergent electron paths during the operation of that prior CPT.

Some Physical Dimensions in Millimeters of Structures of FIGS. 4 and 5

| | FIG. 4 (Novel CPT) | FIG. 5 (Prior CPT) |
|---|---|---|
| Horizontal repeat distance | 0.76 | 0.80 |
| Vertical repeat distance | 0.45 | 0.80 |
| Aperture width | 0.65 | 0.56 |
| Aperture height | 0.31 | 0.56 |
| Horizontal aperture spacing | 0.11 | 0.24 |
| Vertical aperture spacing | 0.14 | 0.24 |
| Conductor width | 0.15 | 0.04 |
| Window width | 0.25 | 0.26 |
| Window height | 0.31 | 0.56 |

TABLE II

Effects of Changing the Dimensions of Windows

| | Dimensions of Windows (mils) | | Repeat Distance (mils) | | Transmission | | $\Delta V$ at |
|---|---|---|---|---|---|---|---|
| Example | Width | Height | Horizontal | Vertical | % | Ratio w/h | 25 kv |
| 1 | 9 | 20 | 30 | 30 | 40 | 0.45 | 1000 |
| FIG. 4 | 10.0 | 12.5 | 29.9 | 18.0 | 46 | 0.8 | 500 |

We claim:

1. In a color television picture tube including (a) a target comprising an array of substantially parallel phosphor stripes of three different emission colors arranged in cyclic order in adjacent triads, each triad comprising a stripe of each of said three different emission colors, (b) means for producing three convergent in-line electron beams directed towards said target in a plane that is substantially normal to said stripes, and (c) a color-selection structure positioned between said target and said beam-producing means, said structure comprising (i) a metal masking plate having therein an array of apertures arranged in columns that are substantially parallel to said phosphor stripes, and (ii) an array of narrow conductors extending substantially parallel to said stripes and insulatingly spaced from said masking plate, with each conductor being substantially centered over the apertures of one of said columns, said masking plate and said conductors defining an array of windows for transmitting therethrough portions of said electron beams, there being two columns of windows between adjacent conductors, the improvement wherein said conductors are opposite and spaced from the boundaries between adjacent triads.

2. The picture tube defined in claim 1 wherein said windows at about the center of said color-selection structure have a width-to-height ratio greater than 0.47.

3. The picture tube defined in claim 1 wherein said windows at about the center of said color-selection structure have a width-to-height ratio of about 0.8 to 1.1.

4. The picture tube defined in claim 1 wherein said apertures are arranged in vertical columns and horizontal lines as said target is normally viewed.

Figure 3:
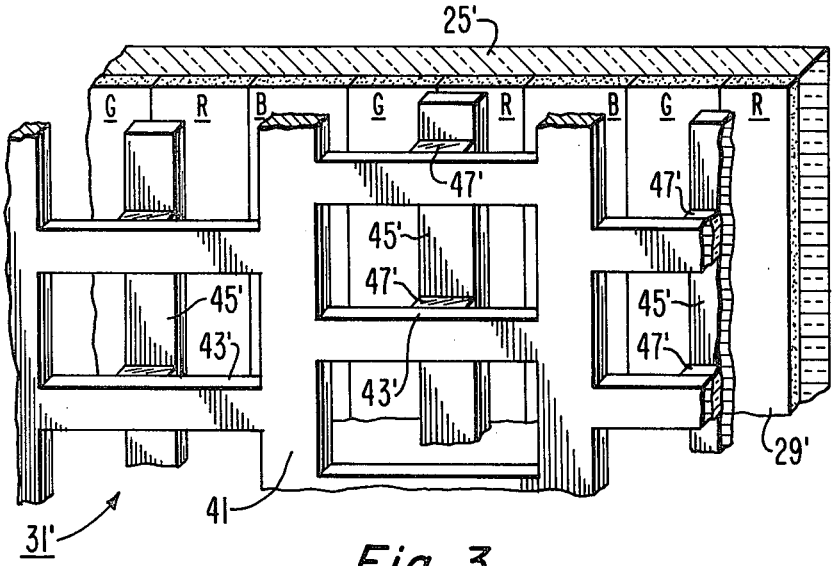
FIG. 3 is a perspective view of fragments of another color-selection structure and viewing screen of an alternative embodiment of a novel CPT including a masking plate having rectangular apertures therein arranged in vertical columns but with the apertures in adjacent columns offset from one another in the vertical direction.

5. The picture tube defined in claim 1 wherein said apertures are arranged in vertical columns, and aper- All of the sizes are exemplary and may be varied as will be described below. The apertures 43 are uniformly sized but may be, if desired, graded in size from the center to the edge of the masking plate 41. Also, the spacing between the masking plate 41 and the stripes R, G and B is uniform but may be graded from the center to the edge of the masking plate 41. As another alternative, the apertures 43 in adjacent columns may be vertically offset from one another as shown in FIG. 3, instead of being in a horizontal line as shown in FIG. 2. To improve the light output of the target, the surfaces of the stripes R, G, and B towards the electron-producing means may be coated with a light-reflective material, such as aluminum metal.

To operate the tube 21, the electron-beam-producing means is energized with the cathode at essentially ground potential. A first positive voltage (V) of about 10,000 volts from a voltage source S1 is applied to the screen and to the masking plate 41, and a second positive voltage ($V-\Delta V$) of about 10,000 volts minus about 200 volts from a source S2 is applied to each of the conductors 45. Three convergent beams 37A, 37B and 37C from the means 25 are made to scan a raster on the viewing screen 29 with the aid of the deflection coils 39. As shown in FIG. 4, the beams approach the masking plate at different but definite angles. FIG. 4 shows only those portions of the beams 37A, 37B and 37C that are of interest for this analysis. Actually, the beams are wider, spanning many apertures and producing many beamlets.

The electrostatic fields produced by the differences in voltages on the masking plate 41 and the conductors 45 cause those beamlets that pass through the windows of the apertures 43 to be deflected away from the conductors 45. Also there is some focusing of the beamlets normal to the direction of the conductors 45, so that the beamlet is compressed in that direction. Because of the spacing between the masking plate 41 and the stripes R, G and B in combination with the different convergent angles, adjacent beamlets from adjacent apertures 43 fall on the same phosphor stripe in overlapping fashion. For example, as shown in FIG. 4, the center beam 37B typically produces two adjacent beamlets 51A and 51B passing through adjacent windows of adjacent apertures 43 which fall on a green-emitting stripe G. The same deflection and focusing occurs at each pair of adjacent windows of adjacent apertures 43 as the center beam 37B scans across the viewing screen 29. Similarly, but at a different angle, one side beam 37A produces two adjacent beamlets 53A and 53B from adjacent windows of adjacent apertures which fall on the same red-emitting stripe R; and the other side beam 37C produces two adjacent beamlets 55A and 55B from adjacent windows of adjacent apertures which fall on the same blue-emitting stripe B.

Referring now to FIG. 5, the foregoing operation is to be compared with the CPT and the mode of operation disclosed in the above-cited West German publication. Some of the physical dimensions of the structures shown in FIGS. 4 and 5 are tabulated in Table I. In the prior structure (FIG. 5), the conductors 45A are centered on the triads, the conductors 45A carry a positive voltage of about 25,000 volts plus about 900 volts ($V+\Delta V$), and the masking plate carries a positive voltage of about 25,000 volts (V). As shown in FIG. 5, the beamlets passing through the windows of the same aperture 43A are deflected towards one another with defocusing action in the direction normal to the length of the conductors 45A, so that the two beamlets fall on the same phosphor stripe. Because the beamlets are defocused or expanded in this direction, they must be strictly limited in size to avoid overlapping and exciting adjacent stripes.

Figure 6A:
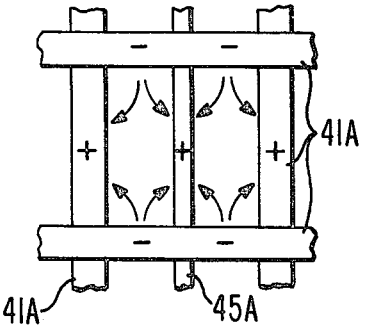
Fig. 6A. PRIOR ART
FIGS. 6A, 6B and 6C are a set of diagrams analyzing the field distributions in the windows of the color-selection structure shown in FIG. 5 for the prior CPT and the prior mode of operation.
Figure 6B:
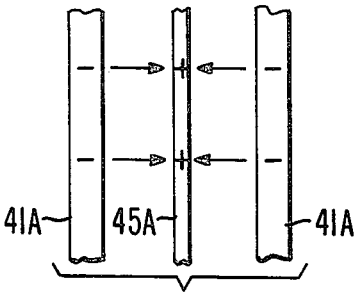
Fig. 6B. PRIOR ART
Figure 6C:
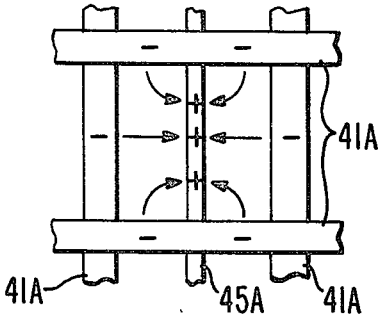
Fig. 6C. PRIOR ART

The prior CPT and mode of operation of the color-selection structure of FIG. 5 can be analyzed by considering each window to have two primary electrostatic lens components. These components include a quadrupole component shown in FIG. 6A and a dipole component shown in FIG. 6B. The quadrupole component is produced by the field between the positive charge at both the right and left of the window formed by the masking plate 41A and the conductors 45A and the negative charge at the top and bottom of that window. Overlaid onto the quadrupole component is a dipole component produced by the field between the positive charge on the conductors 45A and the negative charge on the vertical bars of the masking plate 41A. This dipole component introduces a strong horizontal field between the conductors and the vertical bars that gives a net deflection to a passing beamlet. Combining the two components leads to the combined field configuration shown in FIG. 6C.

Figure 7A:
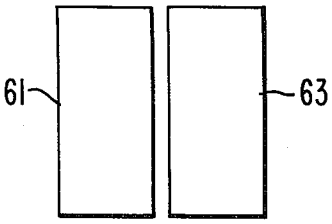
FIGS. 7A and 7B are a set of diagrams showing the electron spot shapes on the target produced by the operation of the prior CPT.
Figure 7B:
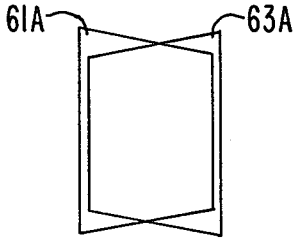

The shortcoming of this prior mode of operation is that the quadrupole component is a defocusing lens for the direction in which the dipole component causes deflection. This defocusing results from the presence of higher quadrupole potentials at the sides of the window, and lower quadrupole potentials at the top and bottom of the window. This gives a net force in the horizontal direction away from the lens center, resulting in defocusing, as described in U.S. Pat. No. 4,059,781 to W. M. van Alphen et al. As the beamlets pass through an aperture, they are made to merge in the horizontal direction at the target, and they are simultaneously defocused in that direction and focused in the vertical direction. Thus, the electron spots on the target, with no voltage difference applied across the masking plate 41A and the conductor 45A, look like the areas 61 and 63 of FIG. 7A, which is substantially the same shape and size as the windows that formed them. After deflection; that is, with the voltage difference applied, the electron spots on the target 29A look like the areas 61A and 63A of FIG. 7B; i.e., they are wider in the deflected direction and shorter normal to that direction. Operation in this prior mode either requires using narrower apertures, which reduces the transmission of the structure, or results in a loss of color purity. While the cited West German publication suggests that the apertures can be shaped to improve the performance of the CPT, the fundamental defocusing by the quadrupole lens that is employed makes it questionable whether suitable correction can be achieved by shaping.

Figure 8A:
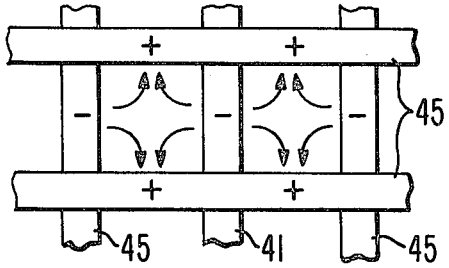
FIGS. 8A, 8B and 8C are a set of diagrams analyzing the field distribution in the windows of the color-selection structure shown in FIG. 4 for the novel CPT and the novel mode of operation.
Figure 8B:
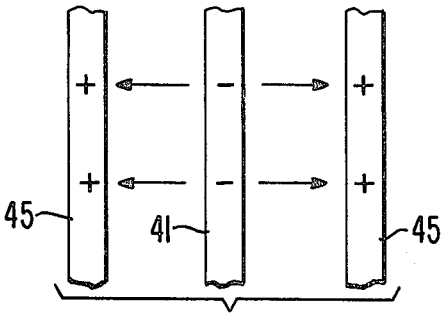
Figure 8C:
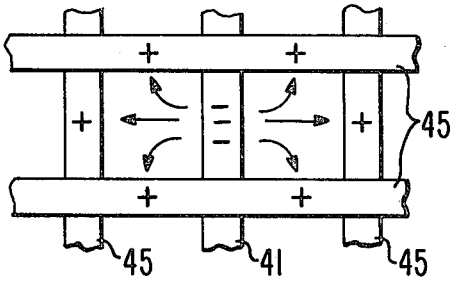

In the novel CPT, the masking structure 31 produces a quadrupole component which reduces the beam width in the deflected direction, which is the horizontal direction as normally viewed. The quadrupole and dipole components of the present mode of operation are shown in FIGS. 8A and 8B respectively. The combined effect is shown in FIG. 8C. A suitable quadrupole component is produced when the masking plate 41, and therefore the aperture perimeter, is made positive and the conductor 45 is negative. This polarity also results in a reversal of the quadrupole and dipole components in the aperture, compared to the components in the prior-art CPT shown in FIG. 6C. As a result, in this novel mode of operation, the two beamlets passing through the wintures of adjacent columns are offset from one another as said target is normally viewed.

6. The picture tube defined in claim 1 including means for applying to said masking plate a positive voltage relative to said electron-beam-producing means, which voltage is operative to accelerate said beams towards said target, and means for applying to said conductors a negative voltage relative to said masking plate, which negative voltage is operative to deflect electron beamlets that are transmitted through said windows incident upon selected ones of said phosphor stripes.

7. In a method for operating the color television picture tube defined in claim 1, the improvement comprising maintaining said masking plate at a substantially constant postive voltage with respect to said electron-beam-producing means, and maintaining said conductors at a substantially constant negative voltage with respect to the voltage on said masking plate, whereby adjacent beam portions transmitted through adjacent windows of adjacent apertures are deflected towards one another and strike areas of particular ones of said stripes.

8. The method defined in claim 7 wherein said vertical conductors are maintained at about 100 to 1,000 volts negative with respect to the voltage on said masking plate.

9. The method defined in claim 7 wherein said vertical conductors are maintained at about 400 to 600 volts negative with respect to the voltage on said masking plate 10. In a color television picture tube including (a) a target comprising an array of substantially parallel phosphor stripes of three different emission colors arranged in cyclic order in adjacent traids, each triad comprising a stripe of each of said three different emission colors, (b) means for producing three convergent electron beams directed towards said target and (c) a color-selection structure positioned between said target and said beam-producing means, said structure comprising (i) a metal masking plate having therein an array of apertures arranged in columns that are substantially parallel to said phosphor stripes, and (ii) an array of narrow conductors extending substantially parallel to said stripes and insulatingly spaced from said masking plate, said masking plate and said conductors defining an array of windows for transmitting therethrough beam portions of said electron beams, there being two columns of windows between adjacent conductors;

the improvement wherein said conductors are opposite and spaced from the boundaries between adjacent triads.

11. In a cathode-ray tube including (a) a target comprising an array of phosphor elements of different emission colors arranged in cyclic order in adjacent color groups, each group comprising an element of each of said different emission colors, (b) means for producing a plurality of convergent electron beams directed towards said target, and (c) a color-selection structure positioned between said target and said beam-producing means, said structure having a plurality of means for transmitting portions of said beams to associated color groups and means for focusing and deflecting said beam portions, said structure comprising (i) a metal masking plate having two opposed major surfaces and having therein an array of substantially rectangular windows arranged in adjacent pairs thereof, and associated therewith (ii) an array of narrow conductors insulatingly spaced from one major surface of said masking plate, and located between said adjacent pairs of said windows, the improvement wherein said conductors are located opposite and spaced from the boundaries between adjacent color groups.

12. In a method for operating the cathode-ray tube defined in claim 11, the improvement comprising maintaining said masking plate at a substantially constant positive voltage with respect to said electron-beam-producing means, and maintaining said conductors at a substantially constant negative voltage with respect to the voltage on said masking plate, whereby the adjacent beam portions transmitted through said window pairs are deflected towards one another and strike areas of particular ones of said elements.

* * * * *